United States Patent [19]

Lester, Jr. et al.

[11] 3,966,566

[45]*June 29, 1976

[54] ELECTROLYTIC HYDRODIMERIZATION PROCESS IMPROVEMENT

[75] Inventors: J. Harvey Lester, Jr., Pensacola; James S. Stewart, Cantonment, both of Fla.

[73] Assignee: Monsanto Company, St. Louis, Mo.

[ * ] Notice: The portion of the term of this patent subsequent to Aug. 5, 1992, has been disclaimed.

[22] Filed: July 25, 1975

[21] Appl. No.: 599,255

Related U.S. Application Data

[63] Continuation of Ser. No. 497,808, Aug. 15, 1974, Pat. No. 3,898,140, which is a continuation-in-part of Ser. No. 385,767, Aug. 6, 1973, abandoned, which is a continuation-in-part of Ser. No. 347,948, April 4, 1973, abandoned, which is a continuation-in-part of Ser. No. 285,975, Sept. 5, 1972, abandoned.

[52] U.S. Cl. ..... 204/73 R; 204/73 A
[51] Int. Cl.[2] ..... C25B 3/10
[58] Field of Search ..... 204/73 R, 73 A

[56] References Cited

UNITED STATES PATENTS

| | | | |
|---|---|---|---|
| 2,685,564 | 8/1954 | Emmett et al. | 204/129.95 X |
| 3,116,105 | 12/1963 | Kerst | 21/2.7 R |
| 3,245,889 | 4/1966 | Baizer | 204/73 A |
| 3,250,690 | 5/1966 | Baizer | 204/73 A |
| 3,427,234 | 2/1969 | Guthke et al. | 204/73 A |
| 3,475,298 | 10/1969 | Andreades | 204/73 A |
| 3,595,764 | 7/1971 | Seko et al. | 204/73 A |
| 3,616,321 | 10/1971 | Verheyden et al. | 204/73 A |
| 3,634,217 | 1/1972 | Bedi et al. | 204/129.95 |
| 3,689,382 | 9/1972 | Fox et al. | 204/73 A |
| 3,897,318 | 7/1975 | Heckle et al. | 204/73 R |

*Primary Examiner*—F.C. Edmundson
*Attorney, Agent, or Firm*—Thomas Y. Awalt, Jr.; George R. Beck

[57] ABSTRACT

In a process for hydrodimerizing an olefinic nitrile, amide or ester by electrolyzing an aqueous solution of the olefinic starting material, quaternary ammonium or phosphonium cations and a conductive salt, formation of hydrogen at the cathode can be substantially inhibited and the current efficiency of the process significantly increased by including in the solution a nitrilocarboxylic acid compound such as a salt of ethylenediaminetetraacetic acid. Particularly good results are obtained when the solution also contains a boric acid, a condensed phosphoric acid or an alkali metal salt thereof.

10 Claims, No Drawings

ELECTROLYTIC HYDRODIMERIZATION PROCESS IMPROVEMENT

CROSS-REFERENCE TO RELATED APPLICATION

This is a continuation of application Ser. No. 497,808 filed Aug. 15, 1974 now U.S. Pat. No. 3,898,140 continuation-in-part of our now-abandoned application Ser. No. 385,767 filed Aug. 6, 1973, as a continuation-in-part of our now-abandoned application Ser. No. 347,948 filed Apr. 4, 1973, as a continuation-in-part our now abandoned application Ser. No. 285,975 filed Sept. 5, 1972.

BACKGROUND OF THE INVENTION

Production of paraffinic dinitriles, dicarboxamides or dicarboxylates by electrolytic hydrodimerization of an alpha, beta-olefinic nitrile, carboxamide or carboxylate is well known, e.g. from U.S. Pat. Nos. 3,193,475-79 and 3,193,481-83 issued July 6, 1965, to M. M. Baizer. Although the process has been sufficiently attractive that it has been in commerical use for over nine years, efforts to develop improvements thereon have been continued with particular emphasis on lowering electric power costs and mitigating electrode corrosion and fouling tendencies because of which it has been heretofore commercially preferable to carry out the process with a cell-dividing membrane.

With the object of maintaining high electrolyte conductivity while employing an electrolysis medium containing organic salts in a proportion small enough for attractive use of a single-compartment (membraneless) cell, one approach to improvement of the process has been to use as the electrolysis medium an aqueous solution of a mixture of quaternary ammonium and alkali metal salts together with the olefinic compound to be hydrodimerized. An example of such an approach is described in Netherlands Patent Application No. 66,10378 laid open for public inspection Jan. 24, 1967, and further development thereof is described in U.S. Pat. No. 3,616,321 issued Oct. 26, 1971, to A. Verheyden et al. and U.S. Pat. No. 3,689,382 issued Sept. 5, 1972, to H. N. Fox et al. However, all known variations of the process are characterized by some degree of inefficiency in use of the electrolyzing current, and this problem is typically even more significant in those process variations that utilize such an undivided cell.

For example, not all of the electroreduction that occurs at the cell cathode takes the form of the desired hydrodimerization reaction or even the generally undesired simple hydrogenation of the olefinic starting material. Instead, a minor but significant proportion normally results in generation of molecular hydrogen. This hydrogen ordinarily accumulates in the electrolysis offgas together with oxygen produced at the anode and, in fact, the proportion of hydrogen in the offgas is a fairly accurate indicator of the proportion of consumed electrolysis current that was wasted on such hydrogen production. At relatively low concentrations of hydrogen in the offgas, the percentage by volume of hyrogen in the offgas is generally about twice the percentage of current consumed in the electrolysis by undesired production of molecular hydrogen. More specifically, the percentage of current consumed in the electrolysis by undesired production of molecular hydrogen is normally equal to fifty times the percentage by volume of hydrogen in the offgas divided by one hundred less the percentage by volume of hydrogen in the offgas, i.e., $50 \times \%H_2/(100-\%H_2)$. For example, a concentration of 10% by volume of hydrogen in an electrolysis offgas usually indicates that about 5.5% of the current consumed in the electrolysis was wasted on molecular hydrogen production and, accordingly, that the current efficiency of the hydrodimerization process was not possibly any greater than about 94.5%.

Clearly, the higher the proportion of the electrolyzing current that produces molecular hydrogen rather than the desired hydrodimer, the greater the cost of production of the hydrodimer will be. Accordingly, a process improvement whereby an olefinic compound from the aforementioned class can be electrolytically hydrodimerized with a resultingly lowered production of molecular hydrogen and a thereby increased current efficiency is highly desirable, and it is an object of this invention to provide such an improvement. Additional objects of the invention will be apparent from the following description and Examples in which all percentages are by weight except where otherwise noted.

SUMMARY OF THE INVENTION

It has now been discovered that in a process of hydrodimerizing an olefinic compound having the formula $R_2C{=}CR{-}X$ wherein $-X$ is $-CN$, $-CONR_2$ or $-COOR'$, R is hydrogen or R' and R' is $C_1$–$C_4$ alkyl by electrolyzing an aqueous solution having dissolved therein at least about 0.1% by weight of the olefinic compound, at least about $10^{-5}$ gram mol per liter of quaternary ammonium of phosphonium cations and at least about 0.1% by weight of conductive salt in contact with a cathodic surface having a cathode potential sufficient for hydrodimerization of the olefinic compound, formation of hydrogen at the cathodic surface can be substantially inhibited and the current efficiency of the process significantly increased by including in the solution at least one nitrilocarboxylic acid compound such as, for example, a nitriloacetic or nitrilopropionic acid compound having the formula $Y_2N{+}Z{-}YN{)}_n{-}R$ $-COOM$ wherein Y is a monovalent radical such as hydrogen, $-R''{-}COOM$, $-{+}CH_2{)}_{m+1}OH$ or $C_1$–$C_{20}$ alkyl; $-R''-$ is $-{+}CH_2{)}_m$ or $-{+}CHR'{+}''-$; R''' is hydroxy, $-COOM$, $-{+}CH_2{)}_m COOM$ or $C_1$–$C_8$ alkyl, hydroxyalkyl or hydroxyhenyl; Z is a divalent $C_2$–$C_6$ hydrocarbon radical; M is a monovalent radical such as hydrogen, alkali metal or ammonium; *m* is 1 or 2; *n* is 0-4; and at least one Y is $-R''{-}COOM$ or $-{+}CH_2{)}_{m+1}OH$. Particularly good results are obtained when the solution also contains a small amount of a boric acid, a condensed phosphoric acid or an alkali metal salt thereof.

DETAILED DESCRIPTION OF THE INVENTION

Olefinic compounds that can be hydrodimerized by the improved process of this invention include those having the structural formula $R_2C{=}CR{-}X$ wherein $-X$ is $-CN$, $-CONR_2$ or $-COOR'$, R is hydrogen or R' and R' is $C_1$–$C_4$ alkyl (i.e., methyl, ethyl, n-propyl, isopropyl, n-butyl, isobutyl or tert-butyl). Compounds having that formula are known as having alpha, beta mono-unsaturation and in each such compound, at least one R may be R' while at least one other R is hydrogen and at least one R', if present, may be an alkyl group containing a given number of carbon atoms while at least one other R', if present, is an alkyl group containing a different number of carbon atoms. Such compounds include olefinic nitriles such as, for example, acrylonitrile, methyacrylonitrile, crotononitrile, 2-methylenebutyronitrile, 2-pentenenitrile, 2-methylenevaleronitrile, 2-methylenehexanenitrile, tiglonitrile or 2-ethylidenehexanenitride; olefinic carboxylates such as, for example, methyl acrylate, ethyl acrylate or ethyl crotonate; and olefinic carboxamides such as, for example, acrylamide, methacrylamide, N-N-diethylacrylamide or N,N-diethylcrotonamide. Best results are generally obtained when the olefinic compound has at least one hydrogen atom directly attached to either of the two carbon atoms joined by the double bond in the aforedescribed structural formula. Also presently of greater utility in the process of this invention are those olefinic compounds wherein R′ in that formula is methyl or ethyl, and particularly acrylonitrile, methyl acrylate and alpha-methyl acrylonitrile.

Products of hydrodimerization of such compounds have the structural formula X—CHR—$CR_2$—$CR_2$—CHR—X wherein X and R have the aforesaid significance, i.e., paraffino dinitriles such as, for example, adiponitrile and 2,5-dimethyladiponitrile; paraffinic dicarboxylates such as, for example, dimethyladipate and diethyl-3,4-dimethyladipate; and paraffinic dicarboxamides such as, for example adipamide, dimethyladipamide and N,N′-dimethyl-2,5-dimethyladipamide. Such hydrodimers can be employed as monomers or as intermediates convertible by known processes into monomers useful in the manufacture of high molecular weight polymers including polyamides and polyesters. The dinitriles, for example, can be hydrogenated by known processes to prepare paraffinic diamines especially useful in the production of high molecular weight polyamides. Other examples of various olefinic compounds that can be hydrodimerized by the process of this invention and the hydrodimers thereby produced are identified in the aforecited U.S. Pat. Nos. 3,193,475-79 and 3,193,481-83.

The invention is herein described in terms of electrolyzing an aqueous solution having dissolved therein certain proportions of the olefinic compound to be hydrodimerized, quaternary ammonium or phosphonium cations and a conductive salt. Such use of the term "aqueous solution" does not imply, however, that the electrolysis medium may not also contain an undissolved organic phase. To the contrary, the process of this invention can be quite satisfactorily carried out by electrolyzing the aqueous solution in an electrolysis medium containing the recited aqueous solution and a dispersed but undissolved organic phase in any proportions at which the aqueous solution is the continuous phase of the electrolysis medium. Hence in some embodiments of the invention, the aqueous solution may be suitably electrolyzed in an electrolysis medium containing essentially no undissolved organic phase, by which is meant either no measurable amount of undissolved organic phase or a minute proportion of undissolved organic phase having no significant effect on the hyrodimer selectivity achieved when the aqueous solution is electrolyzed in accordance with the process of this invention. Such a minute proportion, if present, would be typically less than 5% of the combined weight of the aqueous solution and the undissolved organic phase in the electrolysis medium. In other embodiments, the process of this invention can be carried out by electrolyzing the aqueous solution in an electrolysis medium consisting essentially of the recited aqueous solution and a dispersed but undissolved organic phase in a larger proportion (e.g. up to about 15%, 20% or even more of the combined weight of the aqueous solution and the undissolved organic phase in the electrolysis medium) which may or may not significantly affect the hydrodimer selectivity depending on other conditions of the process. In some continuous process embodiments involving recycle of unconverted olefinic compound and whether present in a minute or larger proportion, such an organic phase is normally made up mainly (most commonly at least about 65% and even more typically at least about 75%) of the olefinic compound to be hydrodimerized and the hydrodimer product with some small amounts of organic hydrodimerization by-products, quaternary ammonium or phosphonium cations, etc. possibly also present. Typically, such an organic phase contains at least about 10%, preferably between about 15 and about 50%, and even more desirably between about 20 and about 40% of the olefinic compound to be hydrodimerized. In any event, however, the concentrations of the constituents dissolved in the aqueous solution to be electrolyzed, as set forth herein, are with reference to the recited aqueous solution alone and not the combined contents of said aqueous solution and an undissolved organic phase which, as aforesaid, may be present but need not be present in the electrolysis medium as the invention is carried out. On the other hand, the weight percentages of undissolved organic phase described herein are based on the combined weight of the aqueous solution and the undissolved organic phase in the electrolysis medium.

Referring to the constituents of the aqueous phase, the olefinic compound to be hydrodimerized will be present in at least such a proportion that electrolysis of the solution, as described herein, results in a substantial amount of the desired hydrodimer being produced. That proportion is generally at least about 0.1% of the aqueous solution, more typically at least about 0.5% and in some embodiments, preferably at least about 1% of the aqueous solution. Inclusion of one or more additional constituents which increase the solubility of the olefinic compound in the solution may permit carrying out the process with the solution containing relatively high proportions of the olefinic compound, e.g. at least about 5 or even 10% or more, but in most embodiments, the aqueous solution contains less than about 5% (e.g. not more than 4.5%) of the olefinic compound and, in many of those embodiments, preferably not more than about 1.8% of the olefinic compound.

The minimum required proportion of quaternary ammonium or phosphonium cations is very small. In general, there need be only an amount sufficient to provide the desired hydrodimer selectivity (typically at least about 75%) although much higher proportions can be present if desired or convenient. In most cases, the quaternary ammonium or phosphonium cations are present in a concentration of at least about $10^{-5}$ gram mol per liter of the aqueous solution. Even more typically their concentration is at least about $10^{-4}$ gram mol per liter of the solution and, in some embodiments employing monovalent mono-quaternary ammonium or phosphonium cations, preferably at least about $5 \times 10^{-4}$ gram mol per liter. Although higher proportions may be present in some cases, as aforesaid, the quaternary ammonium or phosphonium cations are generally present in the aqueous solution in a concentration not higher than about 0.5 gram mol per liter and even more usually not higher than about $10^{-1}$ gram mol per liter. In some preferred embodiments, the concentration of quaternary ammonium or phosphonium cations in the solution is between about $10^{-4}$ and about $10^{-2}$ gram mol per liter.

The quaternary ammonium or phosphonium cations that are present in such concentrations are those positively-charged ions in which a nitrogen or phosphorous atom has a valence of five and is directly linked to other atoms (e.g. carbon) satisfying four fifths of that valence. Such cations need contain only one pentavalent nitrogen or phosphorous atom as in, for example, various monovalent mono-quaternary ammonium (e.g. tetraalkylammonium) or mono-quaternary phosphonium (e.g. tetraalkylphosphonium) cations, but they may contain more than one of such pentavalent atoms as in, for example, various multivalent multi-quaternary ammonium or phosphonium cations such as the bis-quaternary ammonium or phosphonium cations, e.g. polymethylenebis (trialkylammonium or trialkylphosphonium) cations. Mixtures of such monovalent and multivalent quaternary ammonium and/or phosphonium cations can also be used. Suitable mono-quaternary ammonium or phosphonium cations may be cyclic, as in the case of the piperidiniums, pyrrolidiniums and morpholiniums, but they are more generally of the type in which a pentavalent nitrogen or phosphorous atom is directly linked to a total of four monovalent organic groups preferably devoid of olefinic unsaturation and desirably selected from the group consisting of alkyl and aryl radicals and combinations thereof. Suitable multi-quaternary ammonium or phosphonium cations may likewise be cyclic, as in the case of the piperaziniums, and they are typically of a type in which the pentavalent nitrogen or phosphorous atoms are linked to one another by at least one divalent organic (e.g. polymethylene) radical and each further substituted by monovalent organic groups of the kind just mentioned sufficient in number (normally two or three) that four fifths of the valence of each such pentavalent atom is satisfied by such divalent and monovalent organic radicals. As such monovalent organic radicals, suitable aryl groups contain typically from six to 12 carbon atoms and preferably only one aromatic ring as in, for example, a pheny or benzyl radical, and suitable alkyl groups can be straight-chain, branched or cyclic with each typically containing from one to 12 carbon atoms. Although quaternary ammonium or phosphonium cations containing a combination of such alkyl and aryl groups (e.g. benzyltriethylammonium or -phosphonium ions) can be used, many embodiments of the invention are preferably carried out with quaternary cations having no olefinic or aromatic unsaturation. Good results are generally obtained with tetraalkylammonium or tetraalkylphosphonium ions containing at least three $C_2$–$C_6$ alkyl groups and a total of from 8 to 24 carbon atoms in the four alkyl groups, e.g. tetraethyl-, ethyltripropyl-, ethyltributyl-, ethyltriamyl-, ethyltrihexyl-, octytriethyl-, tetrapropyl-, methyltripropyl-, decyltripropyl-, methyltributyl-, tetrabutyl-, amyltributyl-, tetraamyl-, tetrahexyl-, ethyltrihexyl-, diethyldioctylammonium or -phosphonium and many others referred to in the aforecited U.S. Pat. Nos. 3,193,475 - 79 and 3,193,481 - 83. Generally most practical from the economic standpoint are those tetraalkylammonium ions in which each alkyl group contains from two to five carbon atoms, e.g. diethyldiamyl-, tetrapropyl-, tetrabutyl-, amyltripropyl-, tetraamylammonium, etc., and those $C_8$–$C_{20}$ tetraalkylphosphonium ions containing at least three $C_2$–$C_5$ alkyl groups, e.g. methyltributyl-, tetrapropyl-, ethyltriamyl-, octyltriethylphosphonium, etc. Particularly useful are the $C_8$–$C_{16}$ tetraalkylphosphonium ions containing at least three $C_2$–$C_4$ alkyl groups. Similarly good results are obtained by use of the divalent polymethylenebis(trialkylammonium or trialkylphosphonium) ions, particularly those containing a total of from 17 to 36 carbon atoms and in which each trialkylammonium or trialkylphosphonium radical contains at least two $C_3$–$C_6$ alkyl groups and the polymethylene radical is $C_3$–$C_8$, i.e. a straight chain of from three of eight methylene radicals. Presently most attractive from the economic standpoint are the $C_{18}$–$C_{32}$ polymethylenebis(trialkylammonium or trialkylphosphonium) ions in which each trialkylammonium or trialkylphosphonium radical contains at least two $C_3$–$C_5$ alkyl groups and the polymethylene radical is $C_4$–$C_6$. In many embodiments of the invention employing such polymethylenebis(trialkylammonium) ions, the carbon atom content of such ions is preferably from 20 to 34. Presently of specific interest for potential commercial use in the process of this invention are the $C_{20}$–$C_{34}$ hexamethylenebis(trialkylammonium) ions, e.g. those in which trialkylammonium radical trialkylammoniumradical contains at least two $C_3$–$C_6$ alkyl groups, partly because water-soluble salts of such cations can be relatively simply prepared from hexamethylenediamine which is readily available in commercial quantities at relatively lost cost. Also generally preferred are the hexamethylenebis(trialkylammonium or trialkylphosphonium) ions containing from 20 to 30 carbon atoms, e.g. those in which each trialkylammonium or trialkylphosphonium radical contains at least two $C_3$–$C_5$ alkyl groups, and especially the $C_{24}$–$C_{30}$ hexamethylenebis(-trialkylammonium) ions in which each trialkylammonium radical contains at least one and preferably two n-butyl groups. Any of such cations can be incorporated into the aqueous solution to be electrolyzed in any convenient manner, e.g. by dissolving the hydroxide or a salt (e.g. a $C_1$–$C_2$ alkylsulfate) of the desired quaternary ammonium or phosphonium cation(s) in the solution in the amount required to provide the desired concentration of such cations.

One significant advantage of the polymethylenebis(-trialkylammonium) or trialkyphosphonium) ions for use in the present invention is that relative to most of the corresponding tetraalkylammonium and tetraalkylphosphonium ions of the type described hereinbefore, they tend to distribute themselves in higher proportion toward the aqueous phase of a mixture of an aqueous solution of the type electrolyzed in accordance with the present invention and the undissolved organic phase which, as aforesaid, may be present in the aqueous solution during the electrolysis. Whether or not such an organic phase is present in substantial proportion in the aqueous solution during the electrolysis, product hydrodimer is generally most conveniently removed from the electrolyzed solution by adding to the solution (either before or after the electrolysis) an amount of the olefinic starting material in excess of its solubility therein, mixing the solution and the excess olefinic compound until they are substantially equilibrated, and then separating (e.g. decanting) from the resulting mixture a first portion thereof that is richer than said mixture in the olefinic compound and therefore richer than said mixture in the hydrodimer product which is normally substantially more soluble in the olefinic compound than in the electrolyzed aqueous solution. Normally, the hydrodimer product is separated from said first portion of the mixture (e.g. by distillation) while a second portion of the mixture comprising an aqueous solution of the type subjected to electrolysis in accordance with the present invention is recycled and the aqueous solution comprised by said second portion is subjected to more of such electrolysis. In process embodiments in which the hydrodimer product is separated from the electrolyzed solution in the manner just described and in view of the importance of having sufficient quaternary ammonium or phosphonium cations in the aqueous solution to maintain a higher hydrodimer selectivity on further electrolysis of the solution, the use of a quaternary cation that distributes itself in relatively high portion in the aqueous portion of a substantially equilibrated mixture of the type just described is highly attractive from the standpoint of lessening the costs of recovering such cations from the separated (e.g. decanted) organic portion of the mixture and/or loss of such cations due to incomplete recovery from said organic portion of the mixture. Surprisingly, and despite their generally higher carbon content, various bis-quaternary cations of the class defined hereinbefore have been found to distribute themselves toward the aqueous solution in ratios significantly higher (e.g. up to at least 3–4 times higher) than those of the corresponding mono-quaternary cations.

The type of conductive salt employed is not usually critical to inhibition of hydrogen formation by use of a nitrilocarboxylic acid compound as described herein. Hence the conductive salt can be a quaternary ammonium or phosphonium salt such as, for example, a tetraalkylammonium or -phosphonium phosphate, sulfate, alkylsulfate, (e.g. ethylsulfate) or arylsulfonate (e.g. toluene sulfonate). Although organic salts of that general type can be employed as the conductive salt in a divided or single-compartment (undivided) cell, it is generally preferred to use an alkali metal conductive salt, i.e., a salt of sodium, potassium, lithium, cesium or rubidium, especially in undivided electrolytic hydrodimerization (EHD) cells, and many attractive embodiments of the invention are carried out with enough alkali metal salt dissolved in the aqueous solution to provide alkali metal cations constituting more than half of the total weight of all cations in the solution. When such alkali metal salts are used, those of lithium and especially sodium and potassium are generally preferred for economic reasons.

Also preferred for such use are the salts of inorganic and/or polyvalent acids, e.g. a tetraalkylammonium or phosphonium or alkali metal orthophosphate, borate, perchlorate, carbonate or sulfate and particularly an incompletely-substituted salt of that type, e.g., a salt in which the anion has at least one valence satisfied by hydrogen and at least one other valence satisfied by an alkali metal. Examples of such salts include disodium phosphate ($Na_2HPO_4$), potassium acid phosphate ($KH_2PO_4$), sodium bicarbonate ($NaHCO_3$) and dipotassium borate ($K_2HBO_3$). Also useful are the alkali metal salts of condensed acids such as pyrophosphoric, metaphosphoric, metaboric, pyroboric and the like (e.g. sodium pyrophosphate, potassium metaborate, borax, etc.) and/or products of hydrolysis of such condensed acid salts. Depending on the acidity of the solution to be electrolyzed, the stoichiometric proportions of such anions and alkali metal cations in the solution may correspond to a mixture of two or more of such salts, e.g. a mixture of sodium acid phosphate and disodium phosphate, and accordingly, such mixtures of salts (as well as mixtures of salts of different cations, e.g. different alkali metals, and/or different acids, e.g. phosphoric and boric) are intended to be within the scope of the expressions "conductive salt" and "alkali metal phosphate, borate, perchlorate, carbonate or sulfate" as used herein. Any of the alkali metal salts may be dissolved in the aqueous solution as such or otherwise, e.g. as the alkali metal hydroxide and the acid necessary to neutralize the hydroxide to the extent of the desired acidity of the aqueous solution.

The concentration of conductive salt in the solution should be at least sufficient to substantially increase the electrical conductivity of the solution above its conductivity without such a salt being present. In most cases, a concentration of at least about 0.1% is favored. More advantageous conductivity levels are achieved when the solution has dissolved therein at least about 1% of the conductive salt or, even more preferably, at least about 2% of such a salt. In many cases, optimum process conditions include the solution having dissolved therein more than 5% (typically at least 5.5%) of the conductive salt. The maximum amount of salt in the solution is typically limited only by its solubility therein, which varies with the particular salt employed. With salts such as sodium or potassium phosphates and/or borates, it is generally most desirable that the solution contain between about 8 and about 15% of such a salt or mixture thereof.

As aforesaid, generation of molecular hydrogen at the cathode of a process of the type discussed herein can be substantially inhibited by including in the aqueous electrolysis medium at least one nitrilocarboxylic acid compound such as, for example, a nitriloacetic or nitrilopropionic acid compound having the formula $Y_2N\text{-}Z\text{-}YN)_nR''\text{-}COOM$ wherein Y is a monovalent radical such as hydrogen, $-R''-COOM$, $(CH_2)_{m+1}OH$ or $C_1$–$C_{20}$ alkyl (preferably $C_1$–$C_{10}$ alkyl such as ethyl, n-propyl, tert-butyl, n-hexyl, n-decyl, etc.); $-R''-$ is $(CH_2)_m$ or $(CHR''')$; $R'''$ is hydroxy, $-COOM$, $(CH_2)_m COOM$ or $C_1$–$C_8$ alkyl, hydroxyalkyl (e.g. hydroxyethyl) or hydroxyphenyl (e.g. orthohydroxyphenyl); Z is a divalent $C_2$–$C_6$ hydrocarbon (e.g. alkylene) radical such as, for example, n-hexylene, n-butylene, iso-butylene or, generally more desirably, ethylene or n-propylene; M is a monovalent radical such as hydrogen, an alkali metal (e.g. lithium or, usually more desirably, sodium or potassium) or ammonium; $m$ is 1 or 2; $n$ represents the number of repeating $Z\text{-}YN$ groups, if any, and may be 0, 1, 2, 3 or 4; and at least one Y in the formula is $-R''-COOM$ COOM or $(CH_2)_{m+1}OH$, i.e., the compound contains at least one $-R''-COOM$ or $(CH_2)_{m+1}OH$ group in addition to the $-R''-COOM$ group on the right hand end of the formula as shown hereinbefore. At least one such additional $-R''-COOM$ or $(CH_2)_{m+1}OH$ group is usually desirably attached to the nitrogen atom at the left-hand end of the formula but when $n$ is 1, such an additional group may be attached (alternatively or otherwise) to the nitrogen atom in the $Z-YN$ unit, and when $n$ is 2, 3 or 4, any one or more of the nitrogen atoms in the repeating $Z-YN$ units may have such an additional $-R''-COOM$ or $(CH_2)_{m+1}OH$ group attached thereto.

Preferably, but not necessarily, the sequesterant is an aminopolycarboxylic acid compound, i.e., one in which there are at least two $-R''-COOM$ groups. It is also generally desirable for Y to be $C_2$–$C_4$ alkylene and for $n$ to be 0, 1, 2 or 3 (even more desirably 0, 1 or 2 and most preferably 1 or 2). Representative of such compounds are nitrilotriacetic acid, diethylenetriaminepentaacetic acid, N,N-di(2-hydroxyethyl)-glycine, ethylenediaminetetrapropionic acid, N-N'-ethylenebis[2-(o-hydroxyphenyl)]glycine and, typically most favored, ethylenediaminetetraacetic acid and N-hydroxyethylethylenediaminetriacetic acid (hereinafter sometimes represented as EDTA and HEDTA, respectively). In the low concentrations generally employed, they may be added to the electrolysis medium as acids or, usually more conveniently and particularly at the alkaline pH's favored for most embodiments of the invention, as partially or fully neutralized salts thereof (e.g. the water-soluble ammonium or alkali metal salts of such acids). In accordance with procedures known in the art, alkali metal salts of such nitrilocarboxylic acid compounds can be prepared by reacting an appropriate amine (e.g. ethylenediamine) with an alkali metal salt of a chloroacetic acid in the presence of an alkali metal hydroxide, or with hydrogen cyanide and formaldehyde and then an alkali metal hydroxide, or with ethylene glycol to provide hydroxyethyl substituents of nitrogen atom(s) of the amine and then reacting the hydroxyethyl-substituted amine with an alkali metal hydroxide in the presence of cadmium oxide to convert the hydroxyethyl substituents to alkali metal acetate substituents in the proportion desired, or with acrylonitrile in the presence of a base (e.g. sodium hydroxide) and then hydrolyzing the cyanoethylated amine in the presence of an alkali metal hydoxide. Conveniently utilized salts of EDTA, HEDTA and other such nitrilocarboxylic acid compounds are also available commercially. See "Keys to Chelation", Dow Chemical Company, Midland, Michigan (1969).

The minimum concentration of the nitrilocarboxylic acid compound in the aqueous electrolysis medium is only that sufficient to inhibit formation of molecular hydrogen at the cathodic surface of the process. In general, at least about 0.025 millimol of the nitrilocarboxylic acid compound per liter of the solution is desirable and at least about 0.1 millimol per liter is preferred. In most cases having a greater attraction for commercial use, at least about 0.5 millimol per liter is more desirable and at least about 2.5 millimols per liter usually provide even better results. Generally, not more than about 50 millimols per liter are required, although higher concentrations may be employed if desired. Even more typically, economic results are better when the concentration of the nitrilocarboxylic acid compounds in the solution is not greater than 25 millimols per liter. With reference to such concentrations, it should be understood that the nitrilocarboxylic acid compounds used herein may degrade under the conditions of the process, e.g. to compounds that have lower molecular weight and/or fewer —R''—COOM or $+CH_2)_{m+1}OH$ groups but which nevertheless provide the advantages of this invention is substantial measure, and accordingly such degradation products should be considered as equivalent to the undegraded nitrilocarboxylic acid compounds to the extent that they provide the advantages thereof, when measuring or otherwise identifying a nitrilocarboxylic acid compound concentration with reference to the process of this invention. Mixtures of two or more of the aforedescribed nitrilocarboxylic acid compounds may also be used in the process of this invention and accordingly, such mixtures are meant to be within the scope of the expression "a nitrilocarboxylic acid compound" as used in this disclosure and the appended claims.

In substantial measure when carrying out the present process in a cell divided by a cation-permeable membrane and particularly when carrying out the process in a single-compartment cell, generation of hydrogen at the cathode is even more significantly inhibited by including in the electrolysis medium a boric acid, a condensed phosphoric acid or an alkali metal salt thereof. The boric acid or borate may be added to the solution as orthoboric acid, metaboric acid or pyroboric acid and then neutralized to the desired solution pH, e.g. with an alkali metal (preferably the cation of the conductive salt) hydroxide or as a completely or incompletely substituted alkali metal salt of such an acid (e.g. disodium or monosodium orthoborate, potassium metaborate, sodium tetraborate or the hydrated form thereof commonly called borax). The condensed phosphoric acid or phosphate may be added as a polyphosphoric (.e.g pyrophosphoric or triphosphoric) acid and then neutralized to the desired solution pH or as a completely or incompletely substituted alkali metal salt thereof (e.g. tetrasodium pyrophosphate or potassium hexametaphosphate or triphosphate).

In general, the condensed phosphoric acids and their alkali metal salts tend to hydrolyze in the electrolysis medium at rates dependent on their concentration, the solution pH, etc. It is believed, however, that the products of such hydrolysis continue to inhibit the generation of hydrogen at the cathode so long as they remain condensed to at least some degree, i.e., so long as they have not been hydrolyzed to the orthophosphate form, and hence the preferred concentrations of such condensed phosphoric acid compounds are herein expressed in terms of weight percent of a condensed phosphoric acid (which may be that orginally added to the solution or hydrolysis products thereof having a lower but conventionally recognizable degree of molecular condensation) or the molar equivalent of an alkali metal salt thereof. When such a condensed phosphoric acid is used in the process of this invention, and particularly in an undivided cell having a metallic anode (e.g. an anode comprising a ferrous metal such as carbon steel, alloy steel, iron or magnetite), it is generally advantageous for the solution to contain at least about 0.01%, preferably between about 0.02% and about 3%, and often most desirably between about 0.02% and about 2% of the condensed phosphoric acid or the molar equivalent (molecularly equivalent amount) of an alkali metal salt thereof.

The aforementioned boric acids and alkali metal salts thereof, on the other hand, tend to relatively rapidly form in the electrolysis medium a variety of boron-containing ions having relative proportions normally dependent on their concentrations, the solution pH, etc., and generally including both uncondensed (i.e., orthoborate) and condensed (e.b. metaborate, tetraborate, polymeric, ring-containing, etc.) ions, regardless of whether the acids and/or salts originally added to the electrolysis medium were in condensed or uncondensed form at that time. In other words, condensed borates (e.g. tetraborates) normally convert in the electrolysis medium in part to orthoborate ions and in part to other condensed borate ions, while orthoborates added as such generally form various condensed borate ions, depending largely on the solution pH, etc. In any event, it appears that the boron-containing ions are effective for purposes of this invention whether they are present in condensed or uncondensed forms or a mixture thereof and accordingly, preferred concentrations of the boric acids or salts are herein expressed (on the basis of one liter of solution) in terms of gram atoms or boron which may be present in the ionic form of condensed or uncondensed borates or other boron-containing moieties provided by interaction between the electrolysis medium and the boric acids and/or salts added thereto. When such boric acids or salts are used in the process of this invention, and particularly in an undivided cell having a metallic anode (e.g. an anode comprising a ferrous metal such as carbon steel, alloy steel, iron or magnetite) it is generally desirable for the boron concentration in the electrolysis medium to be at least about 0.01 and preferably 0.02 gram atom of boron per liter of solution. It is generally not necessary that the boron concentration in the solution be greater than about 0.9 gram atom per liter and in many cases it need not be greater than about 0.5 gram atom per liter, although higher concentrations are not necessarily detrimental and may be advantageous, e.g. if it is intended that a boric acid salt provide a substantial portion of the electrical conductivity of the electrolysis medium.

In most cases, the pH of the bulk of the electrolysis medium is at least about two, preferably at least about five, more preferably at least about six and more conveniently at least about seven, especially when the process is carried out in an undivided cell having a metallic anode. On the other hand, the overall solution pH is generally not higher than about 12, typically not higher than about eleven and, with the use of sodium or potassium phosphates and/or borates, generally not substantially higher than about ten.

The temperature of the solution may be any level compatible with existance of such of the solution itself, i.e., above its freezing point but below its boiling under the pressure employed. Good results can be achieved between about 5° and about 75°C. or at even higher temperatures if pressures substantially above one atmosphere are employed. The optimum temperature range will vary with the specific olefinic compound and hydrodimer, among other factors, but in hydrodimerization of acrylonitrile to adiponitrile, electrolysis temperatures of at least about 25° are usually preferred and those between about 40° and about 65°C. are especially desirable.

As is well-known, electrolytic hydromierization of an olefinic compound having a formula as set forth hereinbefore must be carried out in contact with a cathodic surface having a cathode potential sufficient for hydrodimerization of that compound. In general, there is no minimum current density with which the present process can be carried out at such a cathodic surface but in most cases, a current density of at least about 0.01 amp per square centimeter (amp/cm$^2$) of the cathodic surface is used and a current density of at least about 0.05 amp/cm$^2$ is usually preferred. Although higher current densities may be practical in some instances, those generally employed in the present process are not higher than about 1.5 amp/cm$^2$ and even more typically not higher than about 0.75 amp/cm$^2$ of the aforedescribed cathodic surface. Depending on other process variables, current densities not higher than about 0.5 amp/cm$^2$ may be preferred in some embodiments of the process.

Although not necessary, a liquid-impermeable cathode is usually preferred. With the use of such a cathode, the aqueous solution to be electrolyzed is generally passed between the anode and cathode at a liner velocity with reference to the adjacent cathodic surface of at least about 0.3 meter per second, preferably at least about 0.6 meter per second and even more preferably between about 0.9 and about 2.4 meters per second although a solution velocity up to 6 meters per second or higher can be employed if desired. The gap between the anode and cathode can be very narrow, e.g. about 1 millimeter or less, or as wide as 12.5 millimeters or even wider, but is usually more conveniently of a width between about 1.5 and about 6.2 millimeters. In the process of this invention, the cathodic surface can be made of virtually any material at which the requisite cathode potential can be provided and which is not dissolved or corroded at an intolerable rate. In general, the process can be carried out with a cathode consisting essentially of cadmium, mercury, thallium, lead, zinc, manganese, tin (possibly not suitable with some nitrile reactants) or graphite, by which is meant that the cathodic surface contains a high percentage (generally at least about 95% and preferably at least about 98%) of one or a combination (e.g. an alloy) of two or more of such materials, but it may contain a small amount of one or more constituents that do not alter the nature of the cathodic surface so as to prevent substantial realization of the advantages of the present invention, particularly as described herein. Such other constituents, if present in substantial concentration, are preferably other materials having relatively high hydrogen overvoltages. Of particular preference are cathodes consisting essentially of cadmium, lead, zinc, manganese, graphite or an alloy of one of such metals, and especially cathodes consisting essentially of cadmium. Best results are usually obtained with a cathodic surface having a cadmium content of at least about 99.5%, even more typically at least about 99.8% and most desirably at least about 99.9% as in ASTM Designation B440-66T (issued 1966).

Cathodes employed in this invention can be prepared by various techniques such as, for example, electroplating of the desired cathode material on a suitably-shaped substrate of some other material, e.g. a metal having greater structural rigidity, or by chemically, thermally and/or mechanically bonding a layer of the cathode material to a similar substrate. Alternatively, a plate, sheet, rod or any other suitable configuration consisting essentially of the desired cathode material may be used without such a substrate, if convenient.

The process of this invention can be carried out in a divided cell having a cation-permeable membrane, diaphragm or the like separating the anode and cathode compartments of the cell in such a way that the aqueous solution containing the olefinic compound undergoing hydrodimerization at the cathode of the cell is not in simultaneous direct contact with an anode of the cell. However, it is especially advantageously carried out in cells not divided in that manner, i.e., in cells which the solution being electrolyzed is in direct physical contact with an anode and cathode of the cell. In fact, and particularly without the presence of a boric or condensed phosphoric acid or salt thereof in the preferred concentrations described hereinbefore, it has been found that the aforementioned nitrilocarboxylic acid compounds, and especially in the concentrations cited hereinbefore, generally substantially inhibit the corrosion of metallic anodes when used in such undivided cells. Anodes whose corrosion may be thereby inhibited include those composed of the heavy metals (i.e., metals having a specific gravity greater than 4.0) such as, for example, platinum, ruthenium, nickel, lead, lead dioxide and, of particular advantage when the conductive salt is a phosphate, borate or carbonate, ferrous materials such as carbon steels, alloy steels, iron and magnetite.

In fact, an especially preferred embodiment of the invention is carried out in an undivided cell having an anode comprising a ferrous metal and with the use of an alkali metal phosphate, borate or carbonate conductive salt and an electrolysis medium having a pH not substantially below seven. Of potential interest from the economic standpoint are those embodiments employing an anode consisting essentially of carbon steel, exemplary compositions of which are listed in the 1000, 1100 and 1200 series of American Iron and Steel Institute and Society of Automotive Engineers standard steel composition numbers, many of which may be found on page 62 of Volume 1, Metals Handbook 8th Edition (1961) published by the American Society for Metals, Metals Park, Ohio.

In general, the carbon steels that are advantageously used as anode materials in the process of this invention contain between about 0.02% carbon (more typically at least about 0.05% carbon) and about 2% carbon. Normally, carbon steels such as those of the AISI and SAE 1000 series of standard steel composition numbers are preferred and those containing between about 0.1 and about 1.5% carbon are typically most desirable. Regardless of the material from which it is made, each anode in the cell may be in the form of a plate, sheet, strip, rod or any other configuration suitable for the use intended. In a preferred embodiment, however, the anode is in the form of a sheet (e.g. of cold-rolled carbon steel) essentially parallel to and closely spaced from a cathodic surface of approximately the same dimensions.

Although the invention described and claimed here is not to be regarded as limited to any particular mechanism proposed therefor, it is presently believed that the nitrilocarboxylic acid compounds (and probably to a lesser extent, if present, the boric and/or condensed phosphoric acid compounds) at least partially sequester heavy metals which tend to accumulate in the electrolysis medium (e.g. as a result of corrosion of the cathode and/or, with use of an undivided cell, corrosion of the anode) and that such sequestration inhibits the deposition of those metals on the cathode of the cell. It is further believed that unsequestered heavy metals (or oxides and/or hydroxides thereof) tend to form colloidal particles in the electrolysis medium and after such deposition, alter the nature of the cathodic surface so as to increase the generation of molecular hydrogen at the expense of process current efficiency. Those beliefs are mainly based on observations that increases in hydrogen production normally accompany increased deposition on the cathode of a relatively dense precipitate which has been identified as essentially completely composed of such heavy metals (principally iron in an undivided cell having a steel anode) and their oxides and hydroxides, and that deposition of the precipitate is substantially inhibited by use of the process improvement described and claimed herein.

The following specific examples of the process of this invention are included for purposes of illustration only and do not imply any limitations on the scope of the invention. Also in these examples, acrylonitrile and adiponitrile are generally represented by AN and ADN, respectively.

EXAMPLE I

In a continuous process, an aqueous solution having dissolved therein approximately 1.5% AN, 1.2% ADN, 0.2% AN EHD byproducts, $4 \times 10^{-3}$ gram mol per liter of ethyltributylammonium cations, 10% of a mixture of incompletely-substituted sodium orthophosphates corresponding to the solution pH of 9, 0.3% of tetrasodium pyrophosphate and 0.018% (0.5 millimols per liter) of the tetrasodium salt of ethylenediaminetetraacetic acid (EDTA) was circulated at 55°C. and a velocity between 1.22 and 1.37 meters per second through an undivided electrolytic cell having an AISI 1020 (0.2%) carbon steel anode separated by a gap of about 2.29 millimeters from a cathode composed of cadmium conforming to ASTm Designation B440-66T (at least 99.9% Cd). The solution, which also had entrained therein approximately 0.8% by weight of an organic phase containing about 55% ADN, 28% AN, 9% AN EHD byproducts and 8% water, was electrolyzed as it passed through the cell with a voltage drop across the cell of about 3.8 volts and a current density of about 0.16 amp/cm$^2$ of cathodic surface and then fed into a decanter for equilibration with an accumulated upper layer having approximately the composition of the aforedescribed organic phase and withdrawal of equilibrated lower (aqueous) layer for recycle through the cell. After 182 hours of electrolysis during which AN and water were continuously added to the circulating aqueous soltuion and an equivalent amount of the organic phase containing product ADN, byproducts and unreacted AN was removed, it was found that AN in the solution had been converted to ADN with an average selectivity of 87.6%, the carbon steel anode had corroded at the average rate of 0.46 millimeter per year and the volume percentage of hydrogen in the electrolysis offgas had averaged 6.4% with a final value of 8.4%.

COMPARATIVE EXAMPLE A

When Example I was repeated except that the tetrasodium salt of EDTA was omitted, it was found after 78 hours that the average ADN selectivity had been 86.6%, the anode had corroded at essentially the same average rate and the volume percentage of hydrogen in the offgas had averaged 11.3% with a final value of 24.3%.

EXAMPLE II

In a continuous process, an aqueous solution having dissolved therein approximately 1.6% AN, 1.2% ADN, 0.2% AN EHD byproducts, ethyltributylammonium cations in a concentration that varied between 9 and 25 $\times 10^{-3}$ gram mol per liter, 9% of a mixture of incompletely-substituted sodium orthophosphates corresponding to the solution pH of 9, 0.1% of tetrasodium pyrophosphate and 0.05 % (1.4 millimols per liter) of the tetrasodium salt of EDTA was circulated at a temperature between 50° and 55°C. and a velocity between 0.91 and 1.22 meters per second through an undivided electrolytic cell having an AISI 1020 carbon steel anode separated by a gap of 3.18 millimeters from a cathode composed of a rolled sheet of cadmium having the composition described in Example I. The solution, which also had entrained therein approximately 4% by weight of an organic phase containing about 54% ADN, 29% AN, 9% AN EHD byproducts and 8% water, was electrolyzed as it passed through the cell with a voltage drop across the cell of 4.5 volts and a current density of 0.23 amp/cm$^2$ of cathodic surface and then fed into a decanter for equilibration and recycle of lower layer as in Example I. After 325 hours of electrolysis during which AN and water were continuously added to the circulating solution and an equivalent amount of the organic phase containing product ADN, byproducts and unreacted AN was removed, it was found that AN in the solution had been converted to ADN with an average selectivity of 86.1%, the steel anode had corroded at the average rate of 0.9 millimeter per year and the volume percentage of hydrogen in the electrolysis offgas had been stable throughout the run at 8 to 10%.

EXAMPLE III

In a continuous process, an aqueous solution having dissolved therein approximately 1.6% AN, 1.2% ADN, 0.2% AN EHD byproducts, $5.8 \times 10^{-3}$ gram mole per liter of ethyltributylammonium cations. 10% of a mixture of incompletely-substituted sodium orthophosphates corresponding to the solution pH of 9, 0.1% of tetrasodium pyrophosphate and 0.05% (1.4 millimols per liter) of the tetrasodium salt of EDTA was circulated at 55°C. and a velocity between 1.22 and 1.37 meters per second through a undivided electrolytic cell having an AISI 1020 carbon steel anode separated by a gap of 2.72 millimeters from a cathode composed of a rolled sheet of cadmium having the composition described in Example I. The solution, which also had entrained therein approximately 1% by weight of an organic phase containing about 54% ADN, 29% AN, 9% AN EHD byproducts and 8% water, was electrolyzed as it passed through the cell with a voltage drop of 4.7 volts and a current density of 0.27 amp/cm$^2$ of cathodic surface and then fed into a decanter for equilibration and recycle of lower layer as in Examples I and II. After 776 hours of electrolysis during which AN and water were continuously added to the circulating solution and an equivalent amount of the organic phase containing product ADN, byproducts and unreacted AN was removed, it was found that AN in the solution had been converted to ADN with an average selectivity of 86.1%, the steel anode had corroded at the average rate of 0.86 millimeter per year and the volume percentage of hydrogen in the electrolysis offgas has gradually increased but to a final value no greater than 15%.

EXAMPLE IV

In a continuous process, an aqueous solution having dissolved therein approximately 1.4% AN, 1.2% ADN, 0.2% AN EHD byproducts, $6.8 \times 10^{-3}$ gram mol per liter of ethyltributylammonium cations, 10% of a mixture of incompletely-substituted sodium orthophosphates corresponding to the solution pH of 9, 0.4% (11.3 millimols per liter) of the tetrasodium salt of EDTA and 2% of sodium tetraborate ($Na_2B_4O_7$) corresponding to 0.43 gram atom of boron per liter of the solution was circulated at 55°C. and a velocity of 1.22 meters per second through an undivided electrolytic cell having an AISI 1020 carbon steel anode separated by a gap of 2.28 millimeters from a cadmium cathode having the composition described in Example I. The solution, which also had entrained therein approximately 0.8% by weight of an organic phase containing about 58% ADN, 25.5% AN, 8.5% AN EHD byproducts and 8% water, was electrolyzed as it passed through the cell with a voltage drop across the cell averaging 3.85 volts and a current density of 0.16 amp/cm$^2$ of cathodic surface in contact with the solution and then fed into a decanter for equilibration and recycle of lower layer as in the previous Examples. After 288 hours of electrolysis during which AN and water were continuously added to the circulating solution and an equivalent amount of the organic phase containing product ADN, byproducts and unreacted AN was removed, it was found that AN in the solution had been converted to ADN with an average selectivity of 87.7%, the carbon steel anode had corroded at the average rate of 0.38 millimeter per year and the volume percentage of hydrogen in the electrolysis offgas had averaged less than 10%.

EXAMPLE V

In a continuous process, an aqueous solution having dissolved therein approximately 1.1% AN, 1.1% ADN, 0.2% AN EHD byproducts, ethyltributylammonium cations in a concentration that varied between 5.1 and $8.7 \times 10^{-3}$ gram mol per liter, 10.3% of a mixture of incompletely-substituted sodium orthophosphates corresponding to the solution pH of 9 and 0.3% (8.5 millimols per liter) of the tetrasodium salt of EDTA was circulated at 50°–55°C. and a velocity of 1.37 meters per second through an undivided electrolytic cell having an AISI 1020 carbon steel anode separated by a gap of 272 millimeters from a cathode composed of cadmium having the composition described in Example I. The solution, which also had entrained therein approximately 4% by weight of an organic phase containing an average of about 61% ADN, 21% AN, 10% AN EHD byproducts and 8% water, was electrolyzed as it passed through the cell with a voltage drop across the cell averaging 4.35 volts and a current density averaging about 0.22 amp/cm$^2$ of cathodic surface and then fed into a decanter for equilibration and recycle of lower layer as in previous Examples. After 159 hours of electrolysis during which AN and water were continuously added to the circulating solution and an equivalent amount of the organic phase was removed, it was found that AN in the solution had been converted to ADN with an average selectivity of 88.3%, the carbon steel anode had corroded at the average rate of 1.27 millimeter per year and the volume percentage of hydrogen in the electrolysis offgas has averaged 5%.

EXAMPLE VI

In a continuous process, an aqueous solution having dissolved therein an average of approximately 1.1% AN, 1.1% ADN, 0.2% AN EHD byproducts, $1.7 \times 10^{-3}$ gram mol per liter of tetrabutylammonium cations, 12.2% of a mixture of incompletely-substituted sodium orthophosphates corresponding to the solution pH of 10, and 0.3% (8.5 millimols per liter) of the tetrasodium salt of EDTA was circulated at 50°C. and a velocity of 1.22 meters per second through an undivided electrolytic cell having an AISI 1020 carbon steel anode separated by a gap of 2.72 millimeters from a lead cathode. The solution, which also had entrained therein approximately 4% by weight of an organic phase containing an average of about 61% ADN, 21% AN, 10% AN EHD byproducts and 8% water, was electrolyzed as it passed through the cell with a voltage drop across the cell averaging 4.25 volts and a current density of 0.22 amp/cm² of cathodic surface and then fed into a decanter for equilibration and recycle of lower layer as in previous Examples. After 154 hours of electrolysis during which AN and water were continuously added to the circulating solution and an equivalent amount of the organic phase was removed, it was found that AN in the solution had been converted to ADN with an average selectivity of 82.2%, the steel anode had corroded at the average rate of about 1.52 millimeter per year and the proportion of hydrogen in the electrolysis offgas had averaged about 2% by volume.

COMPARATIVE EXAMPLE B

In a continuous process, an aqueous solution having dissolved therein approximately 2% AN, 1% ADN, 0.2% AN EHD byproducts, $1.6 \times 10^{-2}$ gram mol per liter of ethyltributylammonium cations and 11.3% of a mixture of incompletely-substituted sodium orthophosphates corresponding to the solution pH of 10 and devoid of any nitrilocarboxylic acid compound was circulated at 50°C. and a velocity of 1.22 meters per second through an undivided electrolytic cell having an AISI 1020 carbon steel anode separted by a gap of 2.72 millimeters from a lead cathode of the type employed in Example VI. The solution, which also had entrained therein approximately 4% by weight of an organic phase containing an average of about 47% ADN, 37% AN, 8% AN EHD byproducts and 8% water, was electrolyzed as it passed through the cell with a voltage drop across the cell averaging 4.6 volts and a currrent density of 0.22 amp/cm² of cathodic surface and then fed into a decanter for equilibration and recycle of lower layer as in previous Examples. After 22 hours of electrolysis during which AN and water were continuously added to the circulating solution and an equivalent amount of the organic phase was continuously removed, it was found that AN in the solution had been converted to ADN with an average selectivity of 79.4%, the steel anode had corroded at the average rate of 10.2 millimeters per year and the volume percentage of hydrogen in the electrolysis offgas was 22%.

EXAMPLE VII

In a continuous process, an aqueous solution having dissolved therein approximately 1.5% AN, 1.2% ADN, 0.2% AN EHD byproducts, ethyltributylammonium cations in a concentration that varied between 2 and 9 $\times 10^{-3}$ gram mol per liter, 10% of a mixture of incompletely-substituted sodium orthophosphates corresponding to the solution pH of 8.5, 0.5% (14.2 millimols per liter) of the tetrasodium salt of EDTA and the mixture of sodium borates produced by neutralizing orthoboric acid in an amount corresponding to 2% of the solution (0.36 gram atoms of boron per liter of the solution) with sodium hydroxide to the solution pH of 8.5 was circulated at a temperature of 55°C. and a velocity of 1.22 meters per second through an undivided electrolytic cell having an AISI 1020 carbon steel anode separated by a gap of 1.78 millimeters from a cathode composed of a rolled sheet of cadmium conforming to ASTM Designation B440-66T (at least 99.9% Cd). The solution, which contained no measurable amount of undissolved organic phase, was electrolyzed as it passed through the cell with a voltage drop across the cell of 3.8 volts and a current density of 0.16 amp/cm² of cathodic surface and then fed into a decanter for equilibration with an accumulated upper layer containing about 55% ADN, 28% AN, 9% AN EHD byproducts and 8% water and withdrawal of equilibrated lower (aqueous) layer for recycle through the cell. After 459 hours of electrolysis during which AN and water were continuously added to the circulating solution and an equivalent amount of accumulated upper layer was removed, it was found that AN in the solution had been converted to ADN with an average selectively of 87.7%, the steel anode had corroded at the average rate of 0.33 millimeter per year and the volume percentage of hydrogen in the electrolysis offgas has been stable throughout the run at less than 8%.

EXAMPLE VIII

In a continuous process, a liquid electrolysis medium composed between 85.9% and 87.5% by (1) an aqueous solution having dissolved therein between 1.4% and 1.6% AN, about 1.2% ADN, 9.6-9.9% of a mixture of sodium orthophosphates, $0.8–2.5 \times 10^{-3}$ mole per liter of ethyltributylammonium ions, about 0.6% (17.0 millimoles per liter) of tetrasodium ethylenediaminetetraacetate ($Na_4EDTA$) and the sodium borates produced by neutralizing orthoboric acid in an amount corresponding to about 2% of the solution to the solution pH of 8.5–9 and between 12.5% and 14.1% by (2) a dispersed but undissolved organic phase containing 26–29% AN, 54–59% ADN, 7–9% AN EHD byproducts and 8% water was circulated at 55°C. and 1.16 meters per second through an undivided electrolytic cell having an AISI 1020 carbon steel anode separated by a gap of 2.25 millimeters from a cathode composed of a rolled sheet of cadmium conforming to ASTM Designation B440-66T (at least 99.9% Cd) and electrolyzed as it passed through the cell with a current density of 0.2 amp/cm² of the surface of the cathode. Organic phase containing product ADN, an EHD byproducts and unreacted AN was separated from the electrolyzed medium and make-up AN was added after which the medium was recirculated through the cell and electrolyzed again under the conditions just described. For each Faraday of current passed through the medium, 0.475 millimole of $Na_4EDTA$ was added to the circulating medium and about 10 grams of the solution were purged from the system and replaced with water containing sufficient dissolved ethyltributylammonium ions and sodium orthophosphates and borates to maintain the concentrations of those constituents of the solution at the aforedescribed levels and the total volume of the medium essentially constant. After 268 hours of electrolysis under those conditions, it was found that AN had been converted to ADN with average and final selectivities of 87–88%, the steel anode had corroded at the average rate of 0.5 millimeter per year and the volume percentage of hydrogen in the offgas had averaged about 6.5% with a final value of 10.4%.

EXAMPLE IX

In a continuous process, a liquid electrolysis medium composed about 99% by (1) an aqueous solution having dissolved therein between 1.4% and 1.6% AN, about 1.2% ADN, 10% of a mixture of sodium orthophosphates, $0.6–1.4 \times 10^{-3}$ mole per liter of methyltributylphosphonium ions, about 0.5% (14.2 millimoles per liter) of $Na_4EDTA$ and the sodium borates produced by neutralizing orthoboric acid in an amount corresponding to about 2% of the solution to the solution pH of about 8.5 and about 1% by (2) a dispersed but undissolved organic phase containing 27–29% AN 54–58% ADN, 7–9% AN EHD byproducts and 8% water was circulated at 55°C. and 1.22meters per second through an undivided electrolytic cell having an AISI 1020 carbon steel anode separated by a gap of 1.76 millimeters from a cadmium cathode essentially the same as that used in Example VIII and electrolyzed as it passed through the cell with a current density of 0.185 amp/cm$^2$ of the surface of the cathode. Organic phase containing product ADN, AN EHD byproducts and unreacted AN was separated from the electrolyzed medium and make-up AN was added after which the medium was recirculated through the cell and electrolyzed again under the conditions just described. For each Faraday of current passed through the medium, 0.4 millimole of $Na_4$-EDTA was added to the circulating medium and about 12 grams of the solution were purged from the system and replaced with water containing sufficient dissolved methyltributylphosphonium ions and sodium orthophosphates and borates to maintain the concentrations of those constituents of the solution at the aforedescribed levels and the total volume of the medium essentially constant. After 120 hours of electrolysis under those conditions, it was found that AN had been converted to ADN with average and final selectivities of 88%, the steel anode had corroded at an average rate less than 0.5 millimeter per year and the volume percent of hydrogen in the offgas had averaged below 1% with a final value of 0.8%.

EXAMPLE X

In a process essentially as described in Example IX except that the quaternary cations in the aqueous solution were 0.2–7.9 × $10^{-3}$ mole per liter of hexamethylenebis(ethyldibutylammonium ions instead of the 0.6–1.4 × $10^{-3}$ mole per liter of methyltributylphosphonium ions, it was found after 330 hours of electrolysis that AN had been converted to ADN with average and final selectivities of 88–89%, the steel anode had corroded at an average rate below 0.5 millimeter per year and the volume percent of hydrogen in the offgas had averaged below 2% with a final value of 4.9%.

EXAMPLE XI

In a process essentially as described in Example IX except that the quaternary cations in the aqueous solution were 0.4–2.6 × $10^{-3}$ mole per liter of tetramethylenebis(tributylammonium) ions instead of the 0.6–1.4 × $10^{-3}$ mole per liter of methyltributylphosphonium ions, it was found after 171 hours of electrolysis that AN had been converted to ADN with average and final selectivities of 87–88%, the steel anode had corroded at an average rate below 0.5 millimeter per year and the volume percent of hydrogen in the offgas had averaged below 7% with a final value of 11.1%.

EXAMPLE XII

In a continuous process, a liquid electrolysis medium composed about 99% by (1) an aqueous solution having dissolved therein between 1.4% and 1.8% AN, about 1.2% ADN, 10–11% of a mixture of sodium orthophosphates about 1.4 × $10^{-3}$ mole per liter of ethyltributylammonium ions about 0.6% (16.3 millimoles per liter) of trisodium hydroxyethylethylenediaminetriacetate ($Na_3$HEDTA) and the sodium broates produced by neutralizing orthoboric acid in an amount corresponding to 2% of the solution to the solution pH of 8.5 and about 1% by (2) a dispersed but undissolved organic phase containing 27–32% AN, 53–59% ADN, 6–7% AN dimerization byproducts and 8% water was circulated at 55°C. and 1.22 meters per second through an undivided electrolytic cell having an AISI 1020 carbon steel anode separated by a gap of 1.78 millimeters from a cadmium (at least 99.9% Cd) cathode and electrolyzed as it passed through the cell with a current density of 0.185 amp/cm$^2$ of the surface of the cathode. Organic phase containing product ADN, AN EHD byproducts and unreacted AN was separated from the electrolyzed medium and make-up AN was added after which the medium was recirculated through the cell and electrolyzed again under the conditions just described. For each Faraday of current passed through the medium, 0.495 millimole of $Na_3$-HEDTA was added to the circulating medium and 12 grams of the solution were purged from the system and replaced with water containing sufficient dissolved ethyltributylammonium ions and sodium orthophosphates and borates to maintain the concentrations of those constituents of the solution at the aforedescribed levels and the total volume of the medium essentially constant. After 241 hours of electrolysis under those conditions, it was found that AN had been converted to ADN with average and final selectivites of 89.3% and 89.0% respectively, the steel anode had corroded at an average rate below 0.5 millimeter per year and the volume percentage of hydrogen in the offgas had averaged 4.5% with a final value of 5.4%.

We claim:

1. In a process for hydrodimerizing an olefinic compound having the formula $R_2C{=}CR{-}X$ wherein —X is —CN, —$CONR_2$ or —COOR′, R is hydrogen or R′, R′ is $C_1$–$C_4$ alkyl and at least one R directly attached to either of the two carbon atoms joined by the double bond in said formula is hydrogen by electrolyzing an aqueous solution having dissolved therein at least about 0.1% by weight of said olefinic compound, at least about $10^{-5}$ gram mol per liter of quaternary phosphonium ions and at least about 0.1% by weight of conductive salt in contact with a cathodic surface having a cathode potential sufficient for hydrodimerization of said olefinic compound, the improvement which comprises including the solution between 0.1 and about 50 millimols per liter of a nitrilocarboxylic acid compound having the formula $Y_2N{-}(Z{-}YN)_n{-}R''{-}COOM$ wherein Y is hydrogen, —R″—COOM, $-(CH_2)_{m+1}OH$ or $C_1$–$C_{20}$ alkyl; —R″— is $-(CH_2)_m-$ or $-(CHR'''-)$; R‴ is hydroxy, —COOM, $-(CH_2)_mCOOM$ or $C_1$–$C_8$ alkyl, hydroxyalkyl or hydroxyphenyl; Z is a divalent $C_2$–$C_6$ hydrocarbon radical; M is hydrogen, alkali metal or ammonium; *m* is 1 or 2; *n* is an integer from 0 to 4 and at least one Y is —R″—COOM or $-(CH_2)_{m+1}OH$.

2. The process of claim 1 wherein Y is —R″—COOM or $-(CH_2)_{m+1}OH$, Z is $C_2$–$C_4$ alkylene, *m* is 1 and *n* is an integer from 0 to 3.

3. The process of claim 2 wherein —R″— is $-(CH_2)_m-$, Z is ethylene and *n* is 0, 1 or 2.

4. The process of claim 3 wherein the nitrilocarboxylic acid compound is selected from the group consisting of ethylenediaminetetraacetic acid, N-hydroxyethylethylenediaminetriacetic acid, diethylenetriamimepentaacetic acid, nitrilotriacetic acid, N,N-di(2-hydroxyethyl)glycine and the alkali metal and ammonium salts of such acids.

5. The process of claim 1 carried out in an undivided cell having a heavy metal anode in contact with said solution.

6. The process of claim 5 wherein the solution contains an alkali metal salt selected from the group consisting of borate in a concentration corresponding to at least about 0.01 gram atom of boron per liter of solution and condensed phosphate in an amount molecularly equivalent to at least about 0.01 % by weight of the corresponding condensed phosphoric acid.

7. The process of claim 5 wherein the conductive salt is an alkali metal phosphate, borate or carbonate and the anode comprises a ferrous metal.

8. The process of claim 7 wherein the nitrilocarboxylic acid compound is selected from the group consisting of ethylenediaminetetraacetic acid, N-hydroxyethylethylenediaminetriacetic acid, diethylenetriaminepentaacetic acid, nitrilotriacetic acid, N,N-di(2-hydroxyethyl) glycine and the alkali metal and ammonium salts of such acids.

9. In a process for hydrodimerizing an olefinic compound having the formula $H_2C{=}CR{-}X$ wherein —X is —CN or —COOR′, R is hydrogen or R′ and R′ is methyl or ethyl by electrolyzing an aqueous solution having dissolved therein at least about 0.5% by weight of said olefinic compound, between about $10^{-5}$ and about 0.5 gram mol per liter of quaternary phosphonium ions and at least about 1% by weight of sodium or potassium phosphate, borate, carbonate or sulfate in contact with a cathodic surface consisting essentially of cadmium or lead with a current density of at least about 0.01 amp/cm$^2$ of cathodic surface, said solution having a pH between about 5 and about 11 and a temperature between about 5° and about 75°C., the improvement which comprises including in the solution between about 0.1 and about 50 millimols per liter of nitrilocarboxylic acid compound having the formula $Y_2N{-}(Z{-}YN)_n{-}R''{-}COOM$ wherein Y is hydrogen, —R″—COOM, $-(CH_2)_{m+1}OH$ or $C_1$–$C_{20}$ alkyl; —R″— is $-(CH_2)_m-$ or $-(CHR'''-)$; R‴ is hydroxy, —COOM, $-(CH_2)_m COOM$ or $C_1$–$C_8$ alkyl, hydroxyalkyl or hydroxyphenyl; Z is a divalent $C_2$–$C_6$ hydrocarbon radical; M is hydrogen, alkali metal or ammonium; *m* is 1 or 2; *n* is an integer from 0 to 4 and at least one Y is —R″—COOM or $-(CH_2)_{m+1}OH$.

10. The process of claim 9 wherein the solution contains an alkali metal borate in a concentration corresponding to at least about 0.02 gram atom of boron per liter of solution.

* * * * *